US010669734B2

(12) United States Patent
Hejazi et al.

(10) Patent No.: US 10,669,734 B2
(45) Date of Patent: Jun. 2, 2020

(54) WALL DAMPER

(71) Applicant: UNIVERSITI PUTRA MALAYSIA, Serdang (MY)

(72) Inventors: Farzad Hejazi, Serdang (MY); Mohd Saleh Bin Jaafar, Serdang (MY)

( * ) Notice: Subject to any disclaimer, the term of this patent is extended or adjusted under 35 U.S.C. 154(b) by 0 days.

(21) Appl. No.: 16/388,799

(22) Filed: Apr. 18, 2019

(65) Prior Publication Data

US 2019/0323254 A1 Oct. 24, 2019

(30) Foreign Application Priority Data

Apr. 18, 2018 (MY) ..... PI 2018701533

(51) Int. Cl.
*E04H 9/02* (2006.01)
*E04B 1/98* (2006.01)

(52) U.S. Cl.
CPC ..... *E04H 9/022* (2013.01); *E04B 1/985* (2013.01)

(58) Field of Classification Search
CPC ... E04H 9/021; E04H 9/022; E04H 2009/026; E04B 1/985

(Continued)

(56) References Cited

U.S. PATENT DOCUMENTS 5,740,652 A * 4/1998 Inoue ..... E04H 9/02 52/167.1
8,881,491 B2 * 11/2014 Christopoulos ..... E04H 9/02 52/741.3

(Continued)

FOREIGN PATENT DOCUMENTS

JP 03025173 A * 2/1991
JP 2004308248 A 11/2004

OTHER PUBLICATIONS

Tokai Rubber Industries, Ltd. and Shimizu Corporation (Aug. 4, 2005), Tokai Rubber Develops Wall Type Vibration-Damping Damper Using High Performance Viscoelastic Rubber and Puts It into Practical Use, Tokai Rubber Industries, Ltd. press release.

*Primary Examiner* — Brent W Herring
(74) *Attorney, Agent, or Firm* — Wayne & Ken, LLC; Tony Hom

(57) ABSTRACT

The present invention relates to a wall damper (100) connected to an upper floor and a lower floor, comprising of a top cap (108), a pair of cover plates (105), a pair of side members (107), and a base (110), interconnected to one another to form a framing structure to accommodate a pair of inner panels (101), a plurality of damping means (103), and a plurality of outer plates (104); characterised in that the pair of inner panels (101) connected vertically to one another by a joint (102); the top cap (108) having a slit (114) for receiving the pair of inner panels (101); the plurality of damping means (103) bounded to both sides of the pair of inner panels (101); the plurality of outer plates (104) bounded to the plurality of damping means (103); a plurality of stiffening members (106) disposed on a surface of each of the pair of cover plates (105); wherein the pair of inner panels (101), the plurality of damping means (103), the plurality of outer plates (104) and the pair of cover plates (105) are arranged in a parallel relationship; wherein the pair of inner panels (101), the joint (102), the plurality of damping means (103), the plurality of outer plates (104), and the pair of cover plates (105), being provided with a plurality of cavities (113) and aligned with one another accordingly for a connecting means (112) transversed therethrough.

7 Claims, 11 Drawing Sheets

(58) Field of Classification Search
USPC ..... 52/167.7, 167.8
See application file for complete search history.

(56) References Cited

U.S. PATENT DOCUMENTS

| | | | | |
|---|---|---|---|---|
| 9,316,014 | B2 * | 4/2016 | Chou | E04H 9/14 |
| 9,970,191 | B2 * | 5/2018 | Hejazi | E04H 9/02 |
| 2013/0283709 | A1 * | 10/2013 | Christopoulos | E04B 1/98 52/167.1 |
| 2015/0204097 | A1 * | 7/2015 | Chou | E04H 9/14 52/167.1 |
| 2017/0362821 | A1 * | 12/2017 | Hejazi | E04H 9/02 |

* cited by examiner

WALL DAMPER

RELATED APPLICATION

This application claims priority to, and the benefits of, the Malaysian Patent Application No. PI 2018701533 filed on Apr. 18, 2018, the content of which is incorporated in its entirety herein.

FIELD OF THE INVENTION

This invention relates to wall type damper, and more particularly to a wall type damper incorporated with a damping rubber for reducing displacement effect of a structure caused by vibration.

DESCRIPTION OF RELATED ARTS

Wall type dampers are widely used in middle-to-high rise buildings with a vibration damping structure. They can dissipate dynamic energy of small and large vibrations like wind and seismic movements. Energy absorbing materials that are used for dampers include metals (e.g. steel), viscoelastic materials (e.g. rubber) and fluids (e.g. oil).

Several approaches for fabricating the wall type damper have been disclosed in the prior arts. For example, JP 2004-308248 discloses a viscous wall for controlling vibration of a building construction. The viscous wall is composed of a resisting plate fixed to an upper skeleton and inserted into a box-shaped wall filled with high viscous fluid. Horizontal movement of the resisting plate in the fluid generates a viscous resistant force for controlling the vibration of a building. The viscous wall is improved by providing a level prevention board in contact with the fluid level for preventing mixing of air into the fluid. In operation, the resisting plate moves in the same direction as vibration and the movement is resisted by the viscous fluid. However, a substantial space will be created at another side of the resisting plate as the resisting plate move to one side. When the vibration causes the resisting plate to return, the space may not be filled up due to slow flowing of the high viscosity fluid. Hence, the stability of the resistance force is difficult to maintain, especially in the occurrence of repeated and large magnitude vibration.

Malaysia Patent Application No. PI 2016700148 discloses a fluid wall damper, comprising a tank connected to a lower floor; a plate connected to an upper floor and extending into the tank; fluid filled in a space between the tank and the plate; characterised by a divider located in the tank, for forming partitions in the tank; wherein the divider has a slit for receiving the plate; a fin connected perpendicular to the plate and parallel to the divider, being disposed in each of the partitions; and a pipe having a double acting stopcock, being provided on a side wall of the tank for each of the partitions, extending outwardly from one side to another side of the fin, for controlling a flow of the fluid; wherein a horizontal movement of the plate with respect to the tank causes the fin to push the fluid through the pipe and the double acting stopcock, from the one side to another side of the fin, allowing a drop of the fluid pressure and thereby dissipating dynamic force of the movement. However, the drawback of this cited art includes the difficulties in compression molding due to bulky structure of the wall damper during the manufacturing process, thereby making the process more cumbersome and cost consuming.

In other example, Tokai Rubber Industries, Ltd. and Shimizu Corporation have developed a wall type damper using high performance viscoelastic rubber and put it into practical use. Said vibration-damping damper comprises a viscoelastic rubber sandwiched between two side steel plates and one middle steel plate. The side steel plates are fixed to the upper beam of the wall with bolts and the middle steel plate is connected to the base of the wall type damper. However, this wall damper assembly leads to the disadvantage of the difficulties in maintenance due to the complication of dismantle of said wall damper.

Accordingly, it can be seen in the prior arts that there exists a need to provide a wall type damper for reducing and dissipating vibration force by applying an alternative mechanism.

REFERENCES

Tokai Rubber Industries, Ltd. and Shimizu Corporation (2005), Tokai Rubber Develops Wall Type Vibration-Damping Damper Using High Performance Viscoelastic Rubber and Puts It into Practical Use, Tokai Rubber Industries, Ltd. press release.

SUMMARY OF INVENTION

It is an objective of the present invention to provide a wall damper incorporated with viscoelastic or similar material in order to dissipate vibration effect.

It is also an objective of the present invention to provide a wall damper with ease of fabrication and maintenance.

Accordingly, these objectives may be achieved by following the teachings of the present invention. The present invention relates to a wall damper connected to an upper floor and a lower floor, comprising of a top cap, a pair of cover plates, a pair of side members, and a base, interconnected to one another to form a framing structure to accommodate a pair of inner panels, a plurality of damping means, and a plurality of outer plates; characterised in that the pair of inner panels connected vertically to one another by a joint; the top cap having a slit for receiving the pair of inner panels; the plurality of damping means bounded to both sides of the pair of inner panels; the plurality of outer plates bounded to the plurality of damping means; a plurality of stiffening members disposed on a surface of each of the pair of cover plates; wherein the pair of inner panels, the plurality of viscoelastic materials, the plurality of outer plates and the pair of cover plates are arranged in a parallel relationship; wherein the pair of inner panels, the joint, the plurality of damping means, the plurality of outer plates, and the pair of cover plates, being provided with a plurality of cavities and aligned with one another accordingly for a connecting means transversed therethrough.

BRIEF DESCRIPTION OF THE DRAWINGS

The features of the invention will be more readily understood and appreciated from the following detailed description when read in conjunction with the accompanying drawings of the preferred embodiment of the present invention, in which.

DETAILED DESCRIPTION OF THE INVENTION

Figure 1A:
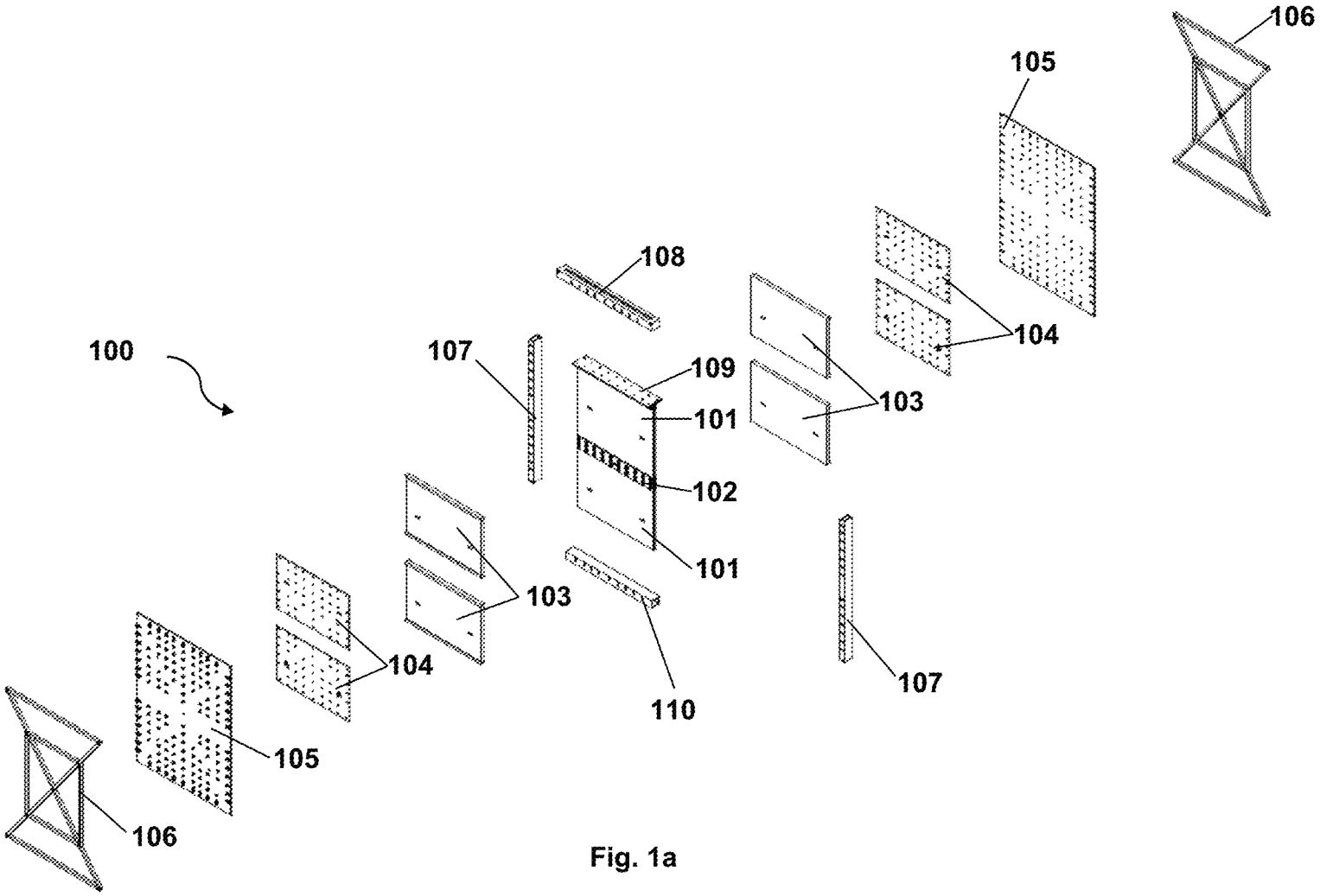
FIG. 1*a* is a drawing showing an exploded view of a wall damper.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting but merely as a basis for claims. It should be understood that the drawings and detailed description thereto are not intended to limit the invention to the particular form disclosed, but on the contrary, the invention is to cover all modifications, equivalents and alternatives falling within the scope of the present invention as defined by the appended claims. As used throughout this application, the word "may" is used in a permissive sense (i.e., meaning having the potential to), rather than the mandatory sense (i.e., meaning must). Similarly, the words "include," "including," and "includes" mean including, but not limited to. Further, the words "a" or "an" mean "at least one" and the word "plurality" means one or more, unless otherwise mentioned. Where the abbreviations or technical terms are used, these indicate the commonly accepted meanings as known in the technical field. For ease of reference, common reference numerals will be used throughout the figures when referring to the same or similar features common to the figures. The present invention will now be described with reference to FIGS. 1*a*-12.

The present invention relates to a wall damper (100) connected to an upper floor and a lower floor, comprising of:

a top cap (108), a pair of cover plates (105), a pair of side members (107), and a base (110), interconnected to one another to form a framing structure to accommodate a pair of inner panels (101), a plurality of damping means (103), and a plurality of outer plates (104);

characterised in that:

the pair of inner panels (101) connected vertically to one another by a joint (102), engaging to the upper floor by a holding means (109) and engaging to the lower floor by a platform (111);

the top cap (108) having a slit (114) for receiving the pair of inner panels (101), in a manner such that the holding means (109) extended out from the slit (114);

the plurality of damping means (103) bounded to both sides of the pair of inner panels (101), for absorbing seismic energy;

the plurality of outer plates (104) mounted bounded to the plurality of damping means (103);

a plurality of stiffening members (106) disposed on a surface of each of the pair of cover plates (105), for increasing rigidity to said wall damper (100);

wherein the pair of inner panels (101), the plurality of damping means (103), the plurality of outer plates (104) and the pair of cover plates (105) are arranged in a parallel relationship;

wherein the pair of inner panels (101), the joint (102), the plurality of damping means (103), the plurality of outer plates (104), and the pair of cover plates (105), being provided with a plurality of cavities (113) and aligned with one another accordingly for a connecting means (112) transversed.

In a preferred embodiment of the wall damper (100), the holding means (109) comprises a flat surface and an inverted U-shaped structure.

In a preferred embodiment of the wall damper (100), the flat surface is connected to the upper floor.

In a preferred embodiment of the wall damper (100), the inverted U-shaped structure of the holding means (109) holds the pair of inner panels (101) in place.

In a preferred embodiment of the wall damper (100), the top cap (108) is configured into inverted U-shaped.

In a preferred embodiment of the wall damper (100), the base (110) is attached to the platform (111).

In a preferred embodiment of the wall damper (100), the plurality of damping means (103) is a high damping rubber sheet or any similar material such as natural rubber.

Below is an example of a wall damper from which the advantages of the present invention may be more readily understood. It is to be understood that the following example is for illustrative purpose only and should not be construed to limit the present invention in any way.

EXAMPLES

The present invention relates to a development of a wall damper (100) incorporated into a structure to dissipate dynamic energy and decrease vibration effects in the structure. FIGS. 1*a* to 2 refer to an embodiment of the panel or wall damper (100) in accordance with the present invention. The wall damper (100) is installed to an upper floor and a lower floor using a connecting means (112) or welding. In a preferred embodiment, the connecting means (112) comprises bolts and nuts. Said wall damper (100) comprises a top cap (108), a pair of cover plates (105), a pair of side members (107), and a base (110), interconnected to one another to form a framing structure to accommodate a pair of inner panels (101), a plurality of damping means (103), and a plurality of outer plates (104). The elements of the top cap (108), the cover plate (105), the side member (107), the base (110), the pair of inner panels (101), the damping means (103), and the outer plates (104) are illustrated in FIGS. 4 to 10.

Figure 3:
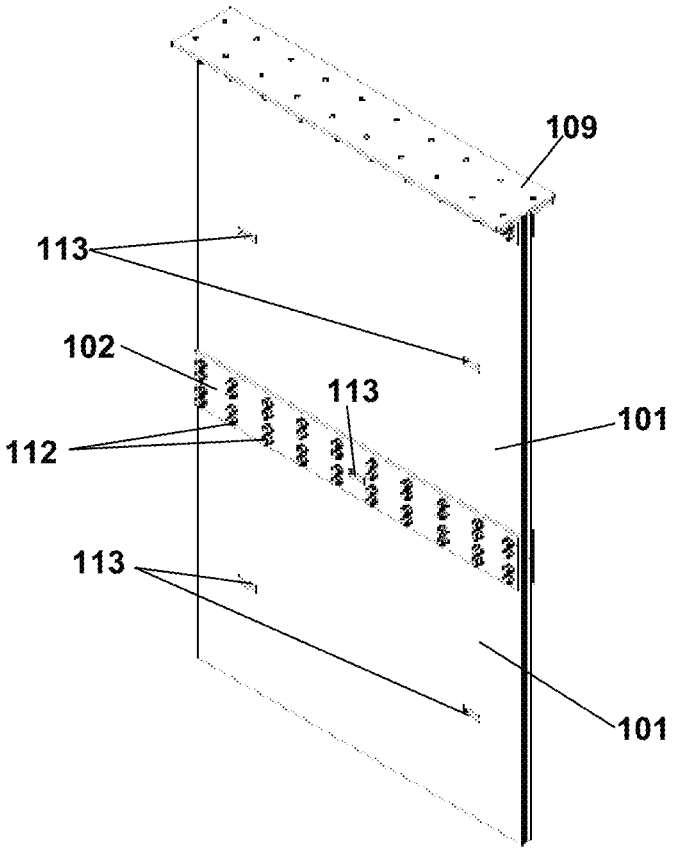
FIG. 3 is a drawing showing elements of a holding means, a pair of inner panels and a joint of the present invention.
Figure 4:
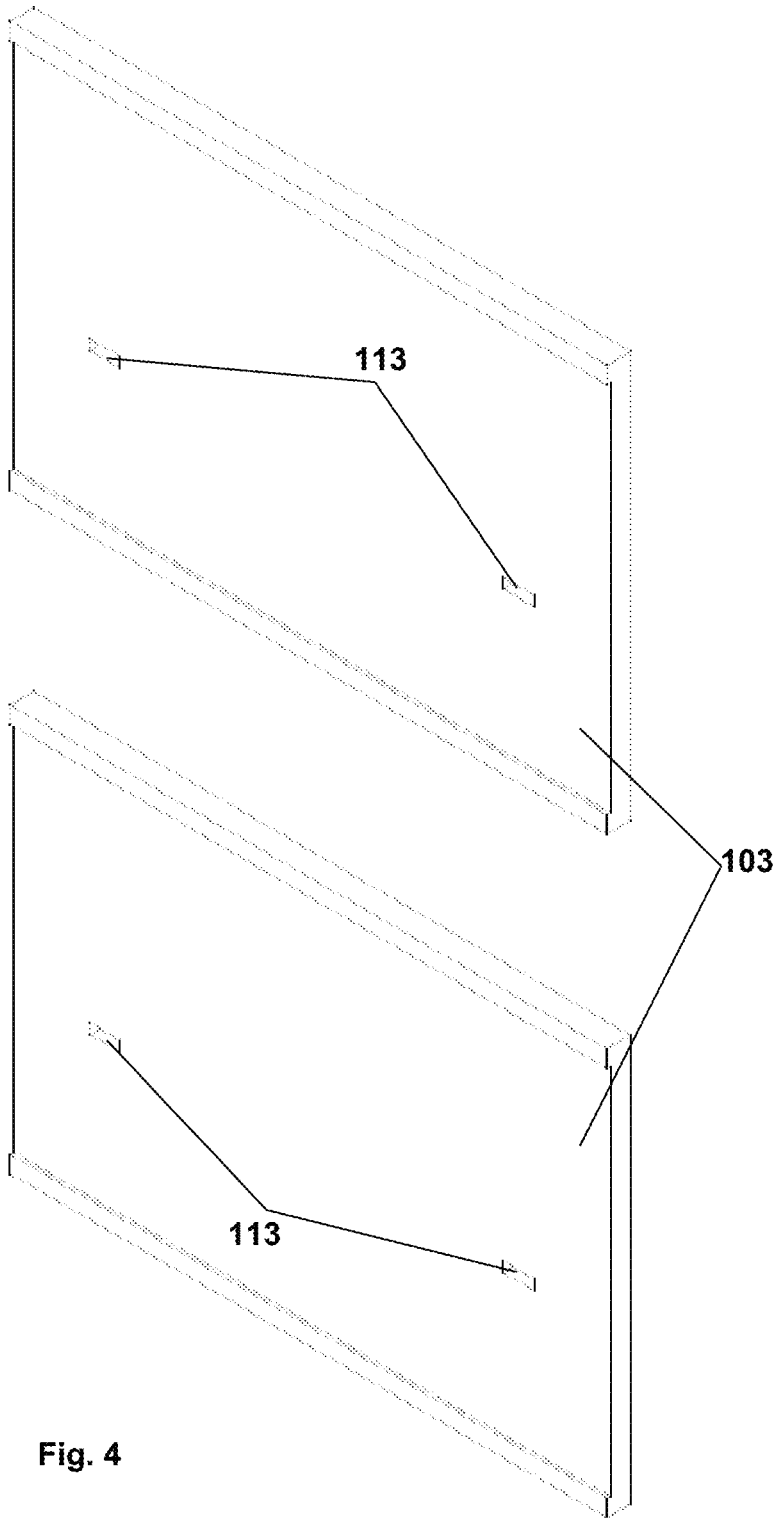
FIG. 4 is a drawing showing the element of damping means of the present invention.
Figure 5:
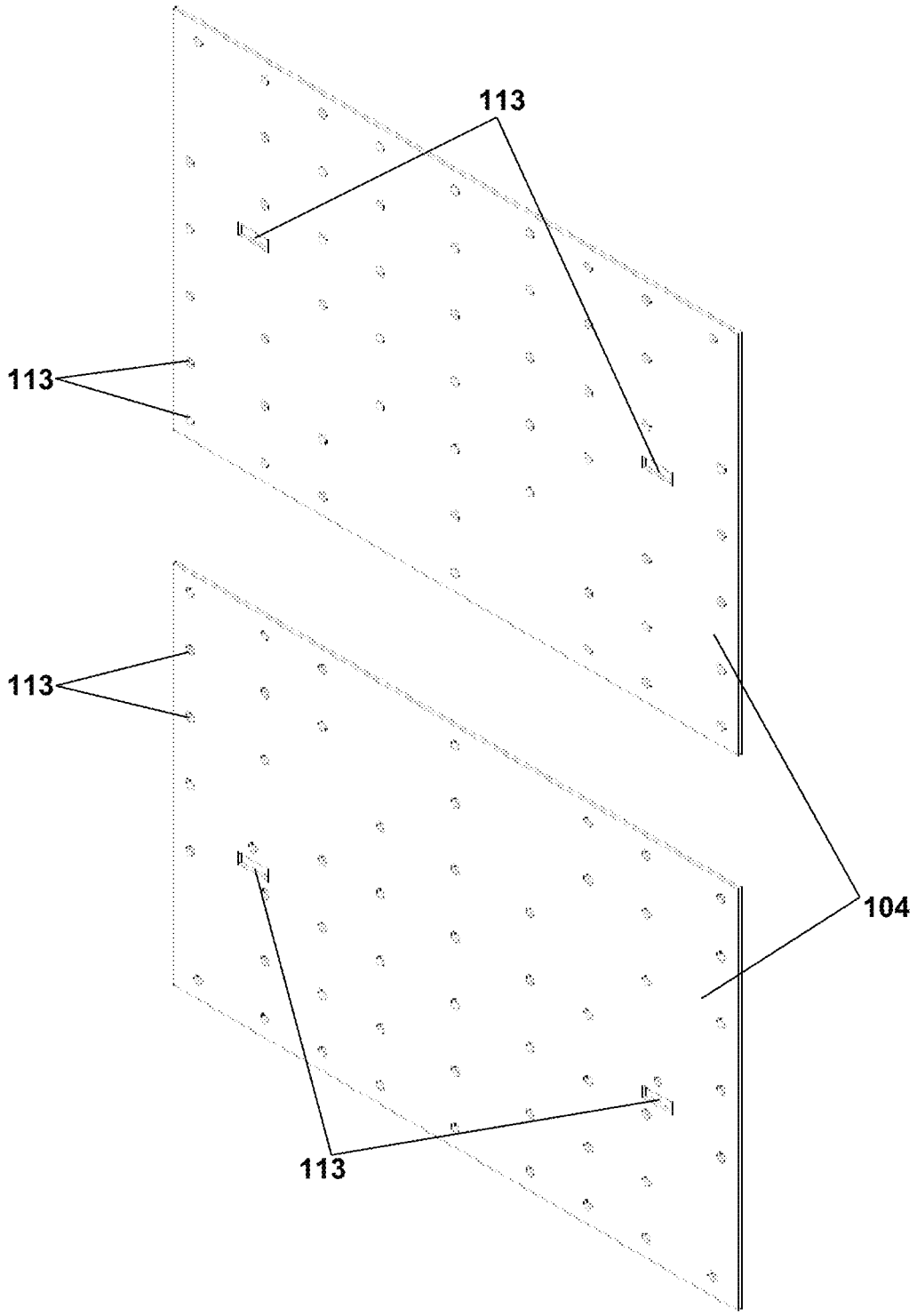
FIG. 5 is a drawing showing the element of outer plates of the present invention.
Figure 6:
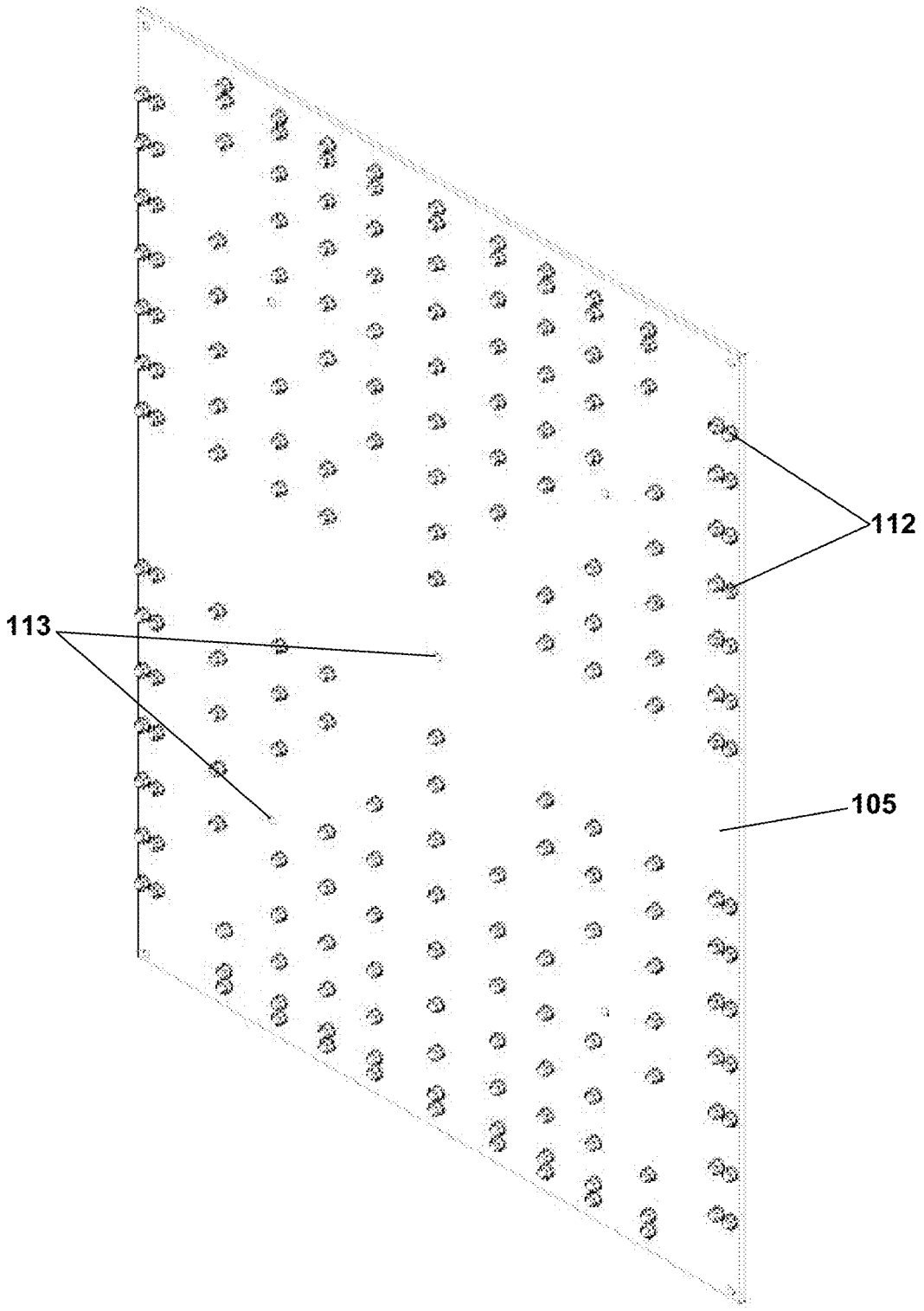
FIG. 6 is a drawing showing the element of cover plate of the present invention.
Figure 7:
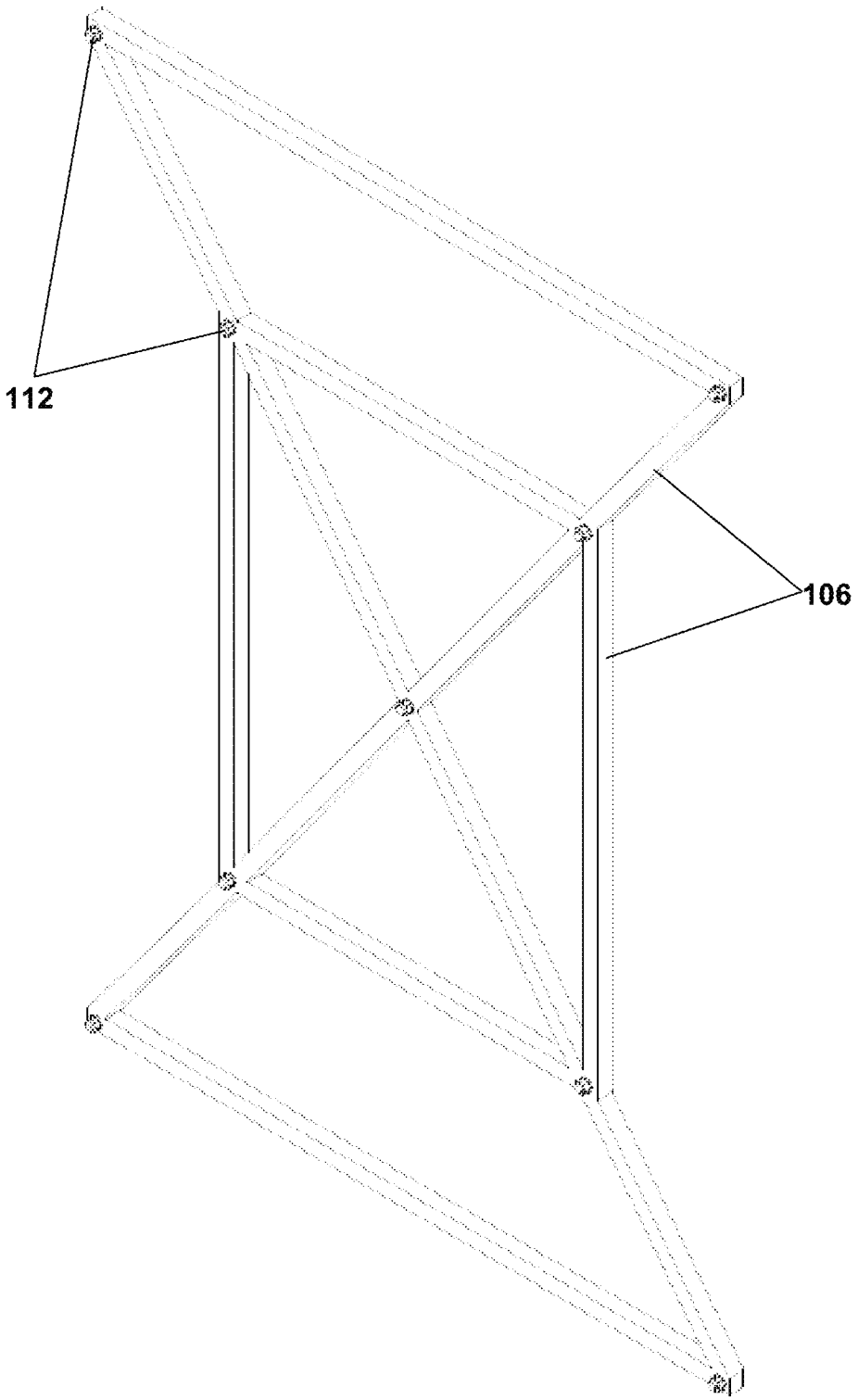
FIG. 7 is a drawing showing plurality of stiffening members of the present invention.
Figure 8:
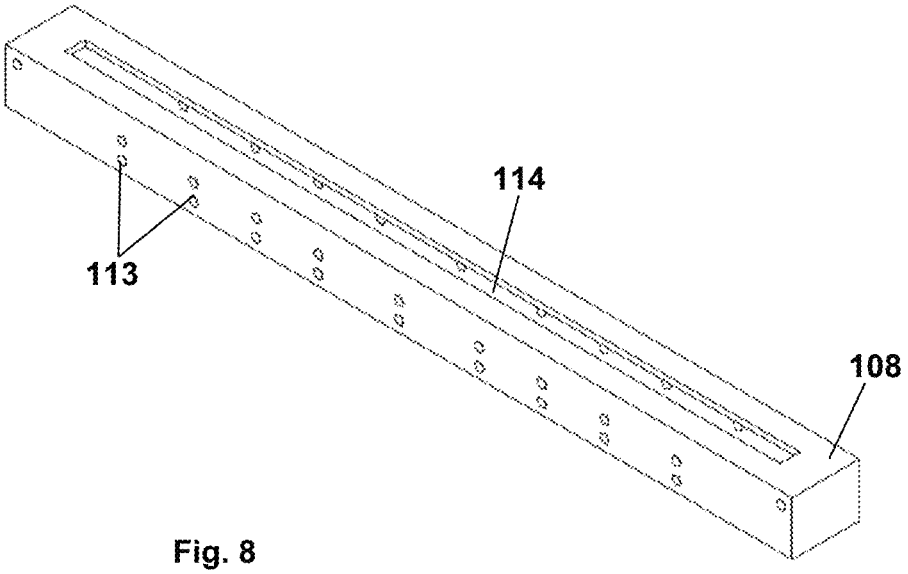
FIG. 8 is a drawing showing the element of top cap of the present invention.
Figure 9:
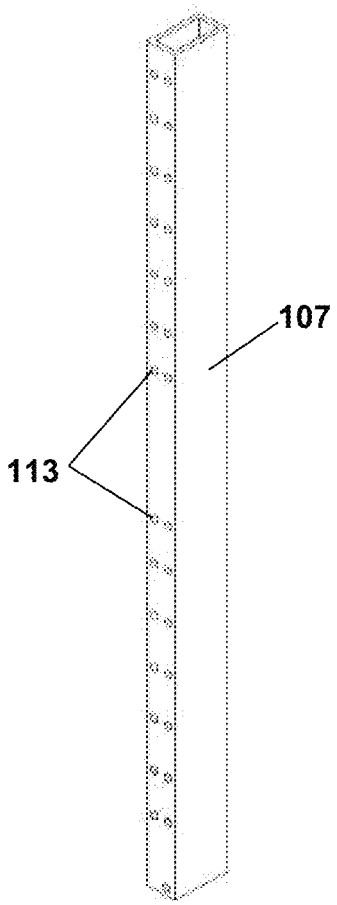
FIG. 9 is a drawing showing the element of side member of the present invention.
Figure 10:
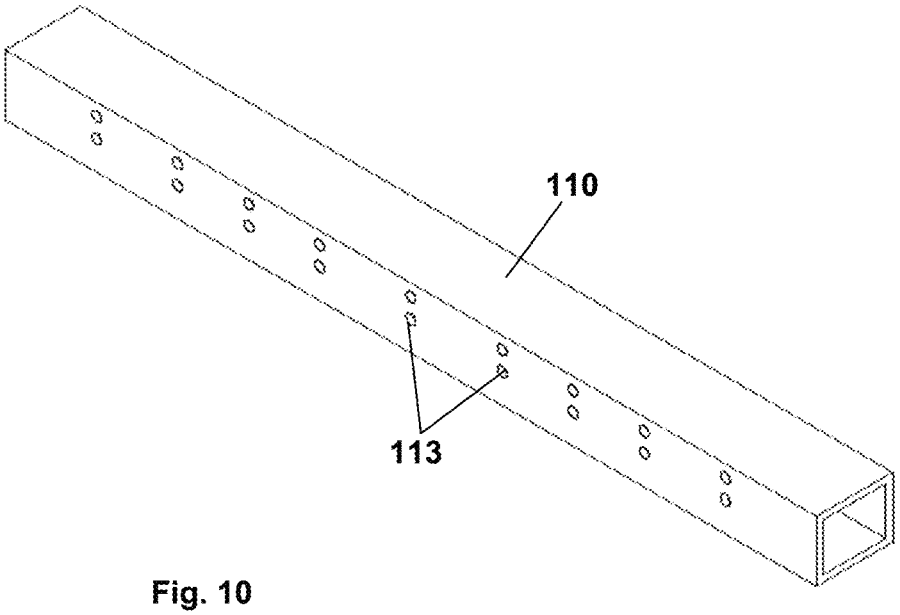
FIG. 10 is a drawing showing the element of base of the present invention.
Figure 11:
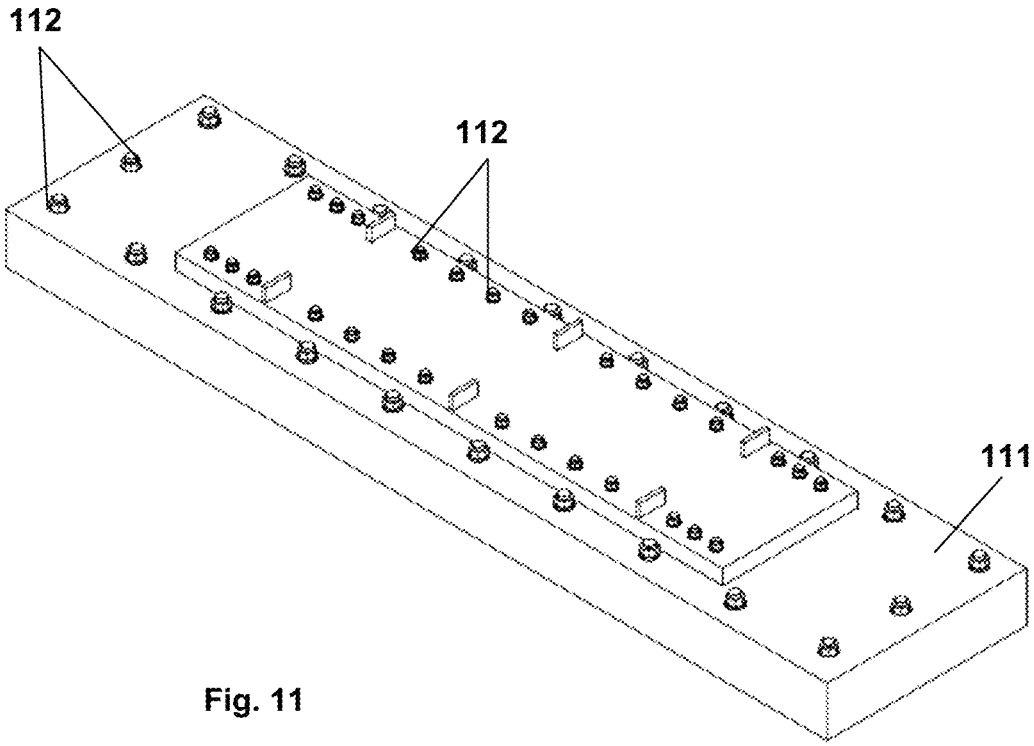
FIG. 11 is a drawing showing the element of platform of the present invention.

Referring to FIG. 3, the pair of inner panels (101) connected vertically to one another by a joint (102) by means of bolts and nuts, rivet, or welding, in a manner such that one of the pair of inner panels (101) is engaged to the upper floor by a holding means (109), while another one of the pair of inner panels (101) is connected to the lower floor by a platform (111). In a preferred embodiment, the pair of inner panels (101) are in the form of single or multi-layers of panels which are arranged in a parallel relationship and able to connect to each other by the connecting means (112) or any types of tying tools which are typically used by a person skilled in the art. In a preferred embodiment, the base (110)

is attached to the platform (111), where the element of the platform is illustrated in FIG. 11.

In a preferred embodiment, the holding means (109) as illustrated in FIG. 3 comprises a flat surface and an inverted U-shaped. The flat surface is connected to the upper floor while the inverted U-shaped structure of the holding means (109) holds the pair of inner panels (101) in place.

The top cap (108) has a slit (114) sized to receive the pair of inner panels (101), in a manner such that the holding mean (109) is extended out from the slit (114) and the pair of inner panels (101) are extended through the length of the framing structure as referred to the FIG. 2.

Referring to FIGS. 1*a*, the plurality of damping means (103) is bounded to both sides of the pair of inner panels (101). In a preferred embodiment, a high damping rubber sheet is used as the damping means (103). The high damping rubber is almost unsusceptible to normal temperature change and excels in terms of vibration resistance. The viscoelastic rubber is low cost and it is available in most of the countries such as Malaysia, Thailand, and Indonesia, just to name a few. The high damping viscoelastic rubber is functioned as dissipating and absorbing inter-storey structure movement and vibration transferred from the upper floor or the lower floor or a combination thereof through the pair of inner panels (101).

Figure 1B:
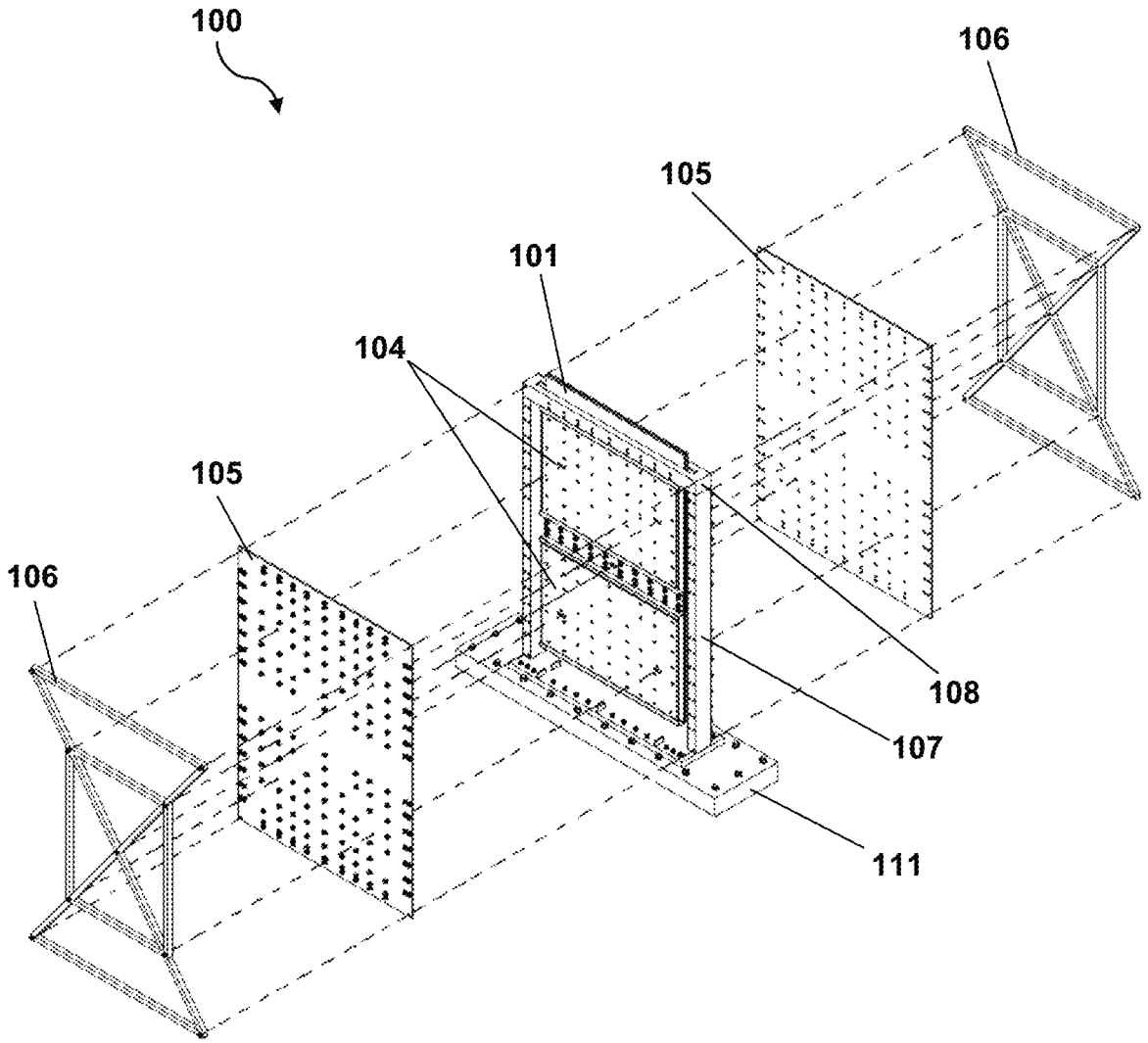
FIG. 1*b* is a drawing showing an isometric view of the wall damper.
Figure 2:
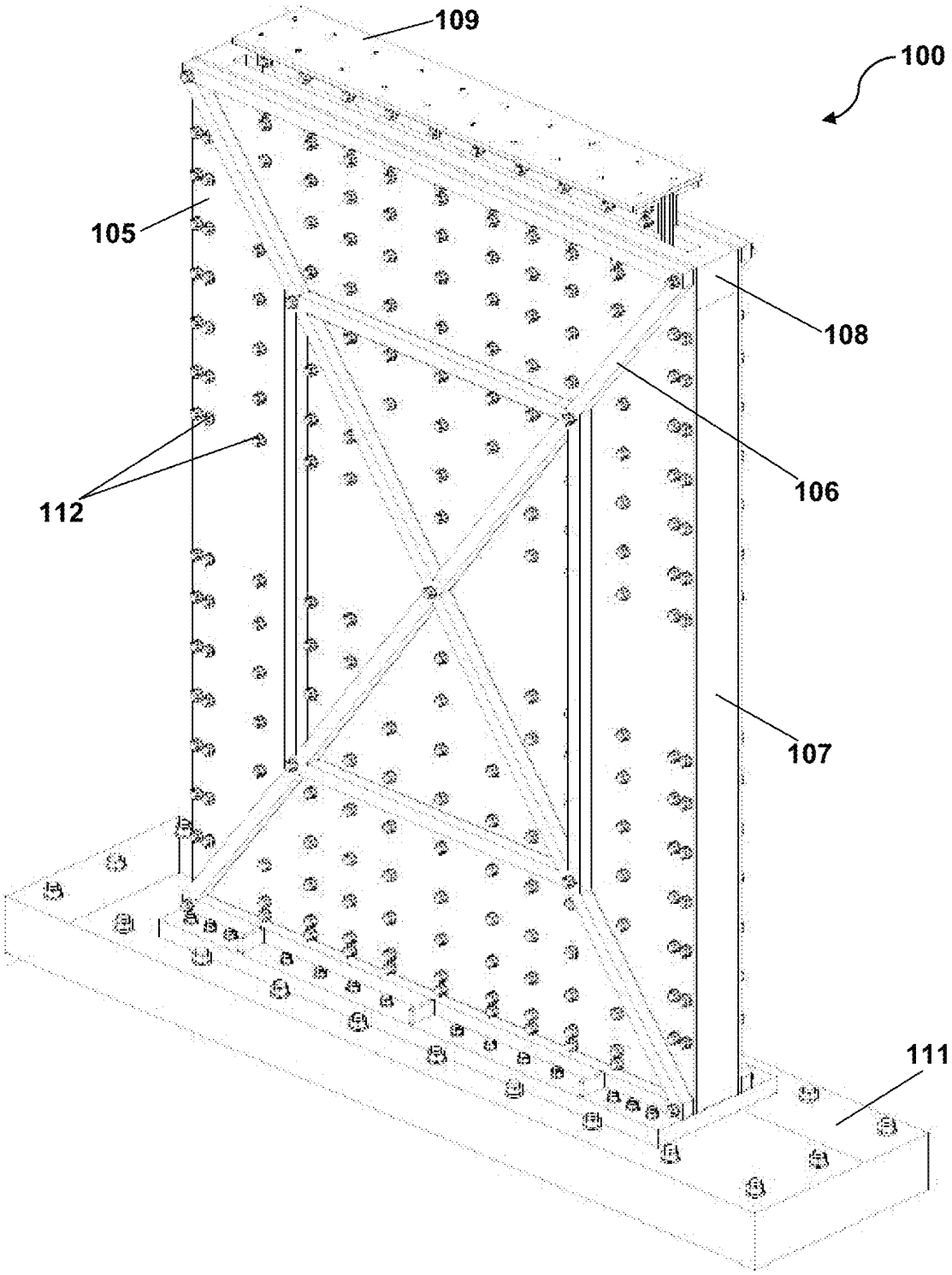
FIG. 2 is a drawing showing an assembled view of the wall damper

FIGS. 1*a* and 1*b* show the plurality of outer plates (104) is bounded to the plurality of damping means (103). In a preferred embodiment, the pair of cover plates (105), the top cap (108), the base (110), the pair of side members (107), the pair of inner panels (101), the plurality of outer plates (104) are preferably made of steel or any strong and durable material which can withstand excessive pressure on said wall damper (100).

The pair of inner panels (101), the joint (102), the plurality of damping means (103), the plurality of outer plates (104) and the pair of cover plates (105) are being provided with a plurality of cavities (113) on their surfaces.

Referring to FIG. 1*b*, the pair of inner panels (101), the plurality of damping means (103), the plurality of outer plates (104) and the pair of cover plates (105) are arranged in a parallel relationship so as to align the plurality of cavities (113) when they are coupled in one assembly for the connecting means (109) transverse therethrough. The joint (102) has at least one cavity that is aligned with the cavity at the pair of the cover plates (105) to enable the connecting means (112) transverse therethrough to secure the wall damper (100) as a whole. The wall damper (100) of the present invention is fabricated in such a manner of where the pair of inner panels (101), the plurality of damping means (103), the plurality of outer plates (104) and the pair of cover plates (105) are each independently being hard-pressed separately for ease of moulding, installation, and maintenance.

A plurality of stiffening members (106) is disposed on a surface of each of the pair of cover plates (105) for increasing rigidity to said wall damper (100) in plane as well as out of plane directions. In a preferred embodiment, the plurality of stiffening members (106) is an elongated rectangular hollow steel, which attached to an outer surface of each of the pair of cover plates (105) as stiffener in horizontal, vertical, and diagonal directions to prevent out-of-plane buckling. The stiffening members (106) can be in any preferred shape and configuration to provide desire stiffness. The attachment of the plurality of stiffening members (106) is preferably by means of the connecting means (112) such as bolts and nuts, rivets, and the like.

For example, during the occurrence of vibration, the vibration is transmitted to the high damping rubber sheet via the steel plates or members, and the vibration of a building structure is damped by rubber deformation thereby causing the vibration energy to be absorbed.

Figure 12:
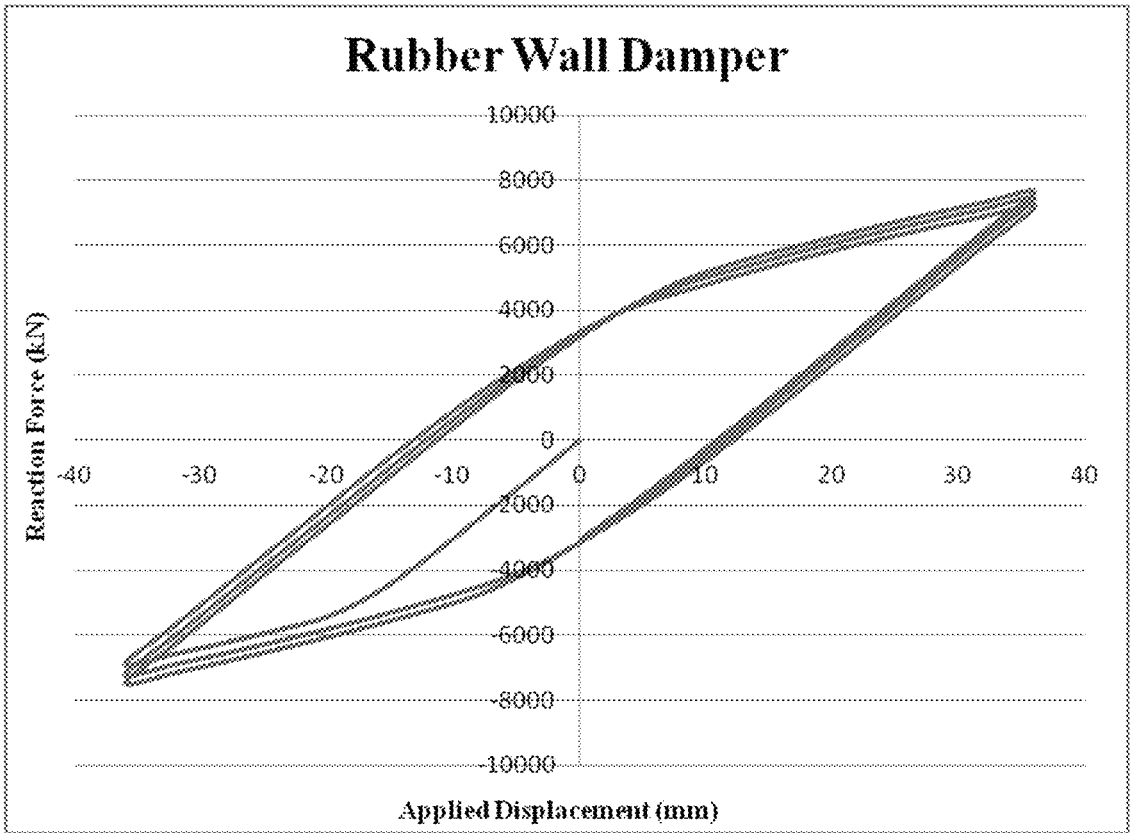
FIG. 12 shows a graph of force with displacement for the performance of the wall damper of the present invention.

FIG. 12 shows a graph of force with displacement for the performance of the wall damper of the present invention.

Although the present invention has been described with reference to specific embodiments, also shown in the appended figures, it will be apparent for those skilled in the art that many variations and modifications can be done within the scope of the invention as described in the specification and defined in the following claims.

Description of the reference numerals used in the accompanying drawings according to the present invention:

| Reference Numerals | Description |
|---|---|
| 100 | Wall damper |
| 101 | A pair of inner panels |
| 102 | Joint |
| 103 | A plurality of damping means |
| 104 | A plurality of outer plates |
| 105 | A pair of cover plates |
| 106 | A plurality of stiffening members |
| 107 | a pair of side members |
| 108 | Top cap |
| 109 | Holding means |
| 110 | Base |
| 111 | Platform |
| 112 | Connecting means |
| 113 | A plurality of cavities |
| 114 | Slit |

The invention claimed is:

1. A wall damper (100) connected to an upper floor and a lower floor, comprising of:

a top cap (108), a pair of cover plates (105), a pair of side members (107), and a base (110), interconnected to one another to form a framing structure to accommodate a pair of inner panels (101), a plurality of damping means (103), and a plurality of outer plates (104);

characterised in that:

the pair of inner panels (101) connected vertically to one another by a joint (102), engaging to the upper floor by a holding means (109) and engaging to the lower floor by a platform (111);

the top cap (108) having a slit (114) for receiving the pair of inner panels (101), in a manner such that the holding means (109) extended out from the slit (114);

the plurality of damping means (103) bounded to both sides of the pair of inner panels (101), for absorbing seismic energy;

the plurality of outer plates (104) bounded to the plurality of damping means (103);

a plurality of stiffening members (106) disposed on a surface of each of the pair of cover plates (105), for increasing rigidity to said wall damper (100);

wherein the pair of inner panels (101), the plurality of damping means (103), the plurality of outer plates (104) and the pair of cover plates (105) are arranged in a parallel relationship;

wherein the pair of inner panels (101), the joint (102), the plurality of damping means (103), the plurality of outer plates (104), and the pair of cover plates (105), being provided with a plurality of cavities (113) and aligned with one another accordingly for a connecting means (112) transversed therethrough.

2. The wall damper (100) according to claim 1, wherein the holding means (109) comprises a flat surface and an inverted U-shaped structure.

3. The wall damper (100) according to claim 2, wherein the flat surface is connected to the upper floor.

4. The wall damper (100) according to claim 2, wherein the inverted U-shaped structure of the holding means (109) holds the pair of inner panels (101) in place.

5. The wall damper (100) according to claim 1, wherein the top cap (108) is configured into inverted U-shaped.

6. The wall damper (100) according to claim 1, wherein the base (110) is attached to the platform (111).

7. The wall damper (100) according to claim 1, wherein the plurality of damping means (103) is a high damping rubber sheet or any similar material such as natural rubber.

* * * * *